US011535052B2

(12) United States Patent
Hanley et al.

(10) Patent No.: US 11,535,052 B2
(45) Date of Patent: Dec. 27, 2022

(54) CHALK LINE MARKING TOOL

(71) Applicant: Innovations Specific, Inc., Fort Collins, CO (US)

(72) Inventors: Jerome Charles Hanley, Fort Collins, CO (US); Duane Neil Genzlinger, Pierce, CO (US)

(73) Assignee: Innovations Specific, Inc., Fort Collins, CO (US)

( * ) Notice: Subject to any disclaimer, the term of this patent is extended or adjusted under 35 U.S.C. 154(b) by 0 days.

(21) Appl. No.: 17/358,964

(22) Filed: Jun. 25, 2021

(65) Prior Publication Data

US 2022/0153058 A1 May 19, 2022

Related U.S. Application Data

(60) Provisional application No. 63/115,008, filed on Nov. 17, 2020.

(51) Int. Cl.
*B44D 3/38* (2006.01)

(52) U.S. Cl.
CPC ..... *B44D 3/38* (2013.01)

(58) Field of Classification Search
CPC ..... B44D 3/38
See application file for complete search history.

(56) References Cited

U.S. PATENT DOCUMENTS 3,016,616 A * 1/1962 Matson ..... G01C 15/10 33/332
4,197,656 A * 4/1980 Lane ..... B44D 3/38 33/414
5,586,394 A * 12/1996 Courtney ..... B44D 3/38 33/413
5,699,622 A 12/1997 Umbro
5,704,131 A * 1/1998 Courtney ..... G01C 15/10 242/381.1
5,822,874 A * 10/1998 Nemes ..... B44D 3/38 33/413
6,895,679 B2 * 5/2005 Dekort ..... B44D 3/38 33/767
6,944,962 B2 9/2005 Tessel et al.
7,478,484 B2 * 1/2009 Nepil ..... B44D 3/38 242/407
7,707,734 B2 * 5/2010 Alexander ..... B44D 3/38 33/1 LE
2003/0221325 A1 * 12/2003 Dekort ..... B44D 3/38 33/414
2008/0301960 A1 * 12/2008 Nepil ..... B44D 3/38 33/414
2009/0025237 A1 * 1/2009 Alexander ..... B44D 3/38 33/414
2022/0153058 A1 * 5/2022 Hanley ..... B44D 3/38
2022/0153059 A1 * 5/2022 Hanley ..... B44D 3/38

FOREIGN PATENT DOCUMENTS

WO 2004094165 A2 11/2004

* cited by examiner

*Primary Examiner* — Yaritza Guadalupe-McCall
(74) *Attorney, Agent, or Firm* — Bridget A. Cochran; Cochran Freund & Young LLC

(57) ABSTRACT

Disclosed is a chalk line marking tool that has a trigger attached to a spring loaded marker. The spring loaded marker has a cord gripper channel that holds a chalk covered cord. When the trigger is actuated, the spring loaded marker marks a surface with a chalk line mark.

11 Claims, 9 Drawing Sheets

CHALK LINE MARKING TOOL

CROSS-REFERENCE TO RELATED APPLICATION

This Non-Provisional patent application claims the benefit of the U.S. Provisional Patent Application No. 63/115,008, entitled "Retrofittable Chalk Line Marking Apparatus," which was filed with the U.S. Patent & Trademark Office on Nov. 17, 2020, which is specifically incorporated herein by reference for all that it discloses and teaches.

BACKGROUND

Tools are an important part of life that can assist with construction and other projects. Sometimes chalk lines are used in construction and other projects for marking a straight line.

SUMMARY

An embodiment of the present invention may therefore comprise a chalk line marking tool used with a marking cord to create a chalk line on a surface comprising: a main body extending in a longitudinal direction; main body surface stabilizers that extend away from the main body and are configured to be flush with the surface; a trigger having a trigger front portion, a trigger rear portion, and a trigger actuator positioned between the trigger front portion and the trigger rear portion, wherein the trigger actuator protrudes from the trigger front portion and the trigger rear portion in an axial direction and a transverse direction that are perpendicular to each other and perpendicular to the longitudinal direction of the main body; a spring loaded marker connected to the trigger and configured to move with the trigger, marker surface stabilizers on the spring loaded marker that are configured to be flush with the surface and align with the main body surface stabilizers on the main body; a trigger spring having a front end connected to the spring loaded marker and a back end connected to the end cap.

An embodiment of the present invention may further comprise a method of making a chalk line marking tool comprising: securing one end of a trigger spring to a rear spring holder on an end cap, and securing the opposite end of the trigger spring to a front spring holder on a spring loaded marker; sliding the spring loaded marker into a main body of the chalk line marking tool; sliding a right trigger rail and a left trigger rail located on a trigger into a right trigger channel and a left trigger channel located on the main body so that the trigger slides along the right trigger channel and the left trigger channel of the main body; securing the end cap to the main body of the chalk line marking tool so that the trigger spring biases the spring loaded marker towards main body surface stabilizers on the main body; securing the trigger to the spring loaded marker so that the spring loaded marker moves with the trigger.

An embodiment of the present invention may further comprise: a chalk line marking tool used with a marking cord to create a chalk line on a surface comprising: a main body extending along a main body longitudinal axis; main body surface stabilizers that extend away from the main body along a transverse axis that is perpendicular to the main body longitudinal axis, and the main body surface stabilizers are configured to be flush with the surface; a trigger having a trigger front portion extending along the main body longitudinal axis, a trigger rear portion extending along the main body longitudinal axis, and a trigger actuator positioned between the trigger front portion and the trigger rear portion, wherein the trigger actuator protrudes from the trigger front portion and the trigger rear portion along the transverse axis, and along a lateral axis that extends laterally from the main body longitudinal axis and is perpendicular to the main body longitudinal axis and the transverse axis; a spring loaded marker connected to the trigger and configured to move with the trigger comprising: a main shaft that extends along the main body longitudinal axis; a right flange extending from the main body longitudinal axis along the lateral axis; a left flange extending from the main body longitudinal axis along the lateral axis; marker surface stabilizers that protrude from the main body longitudinal axis along the transverse axis, and are configured to be flush with the surface and align with the main body surface stabilizers on the main body; an end cap connected to the main body; a trigger spring having a front end connected to the spring loaded marker and a back end connected to the end cap.

DETAILED DESCRIPTION OF THE EMBODIMENTS

Figure 1:
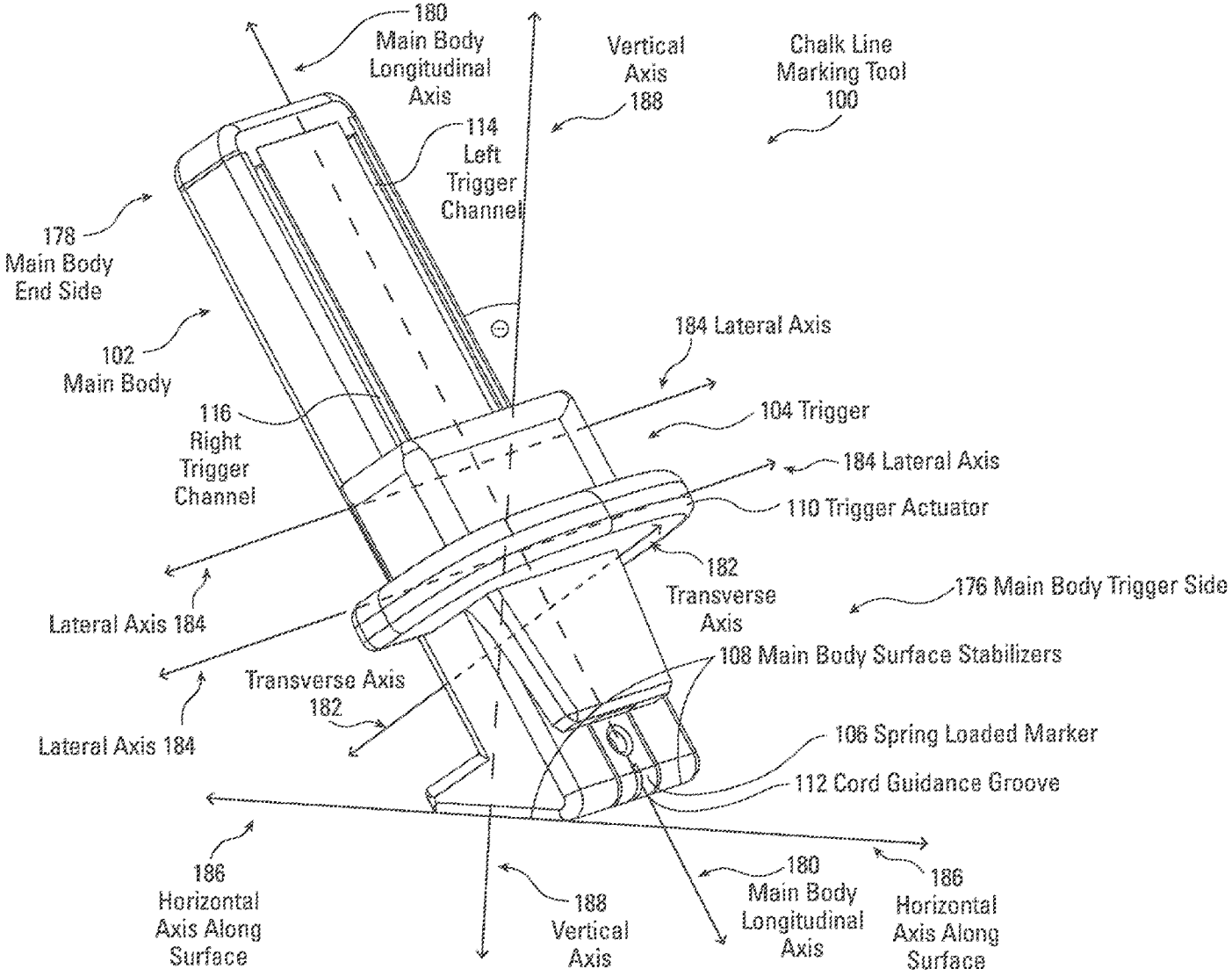
FIG. 1 is an isometric view of chalk line marking tool 100.
Figure 8:
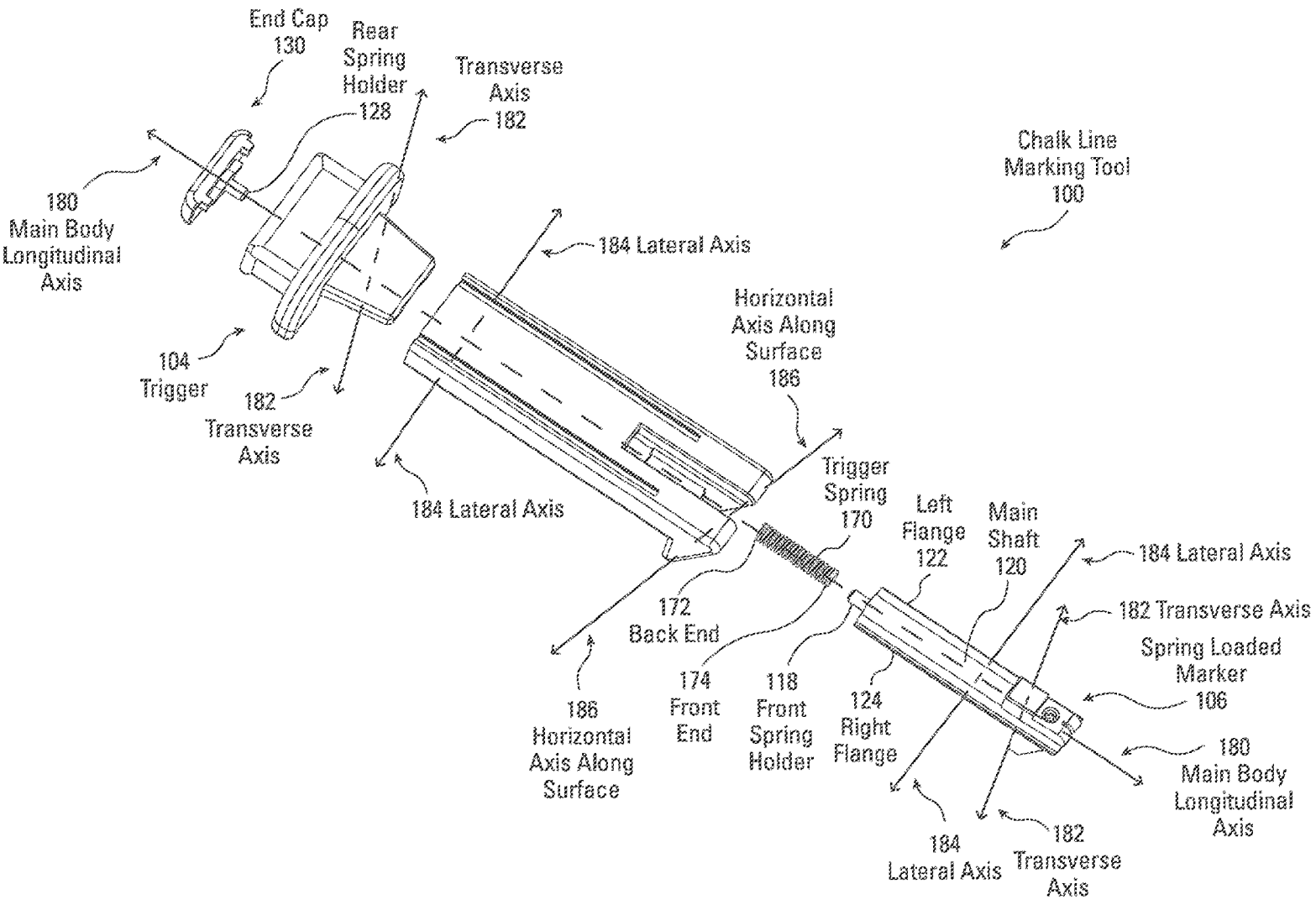
FIG. 8 is an exploded view of FIG. 1.

FIG. 1 is an isometric view of a chalk line marking tool 100 that assists in marking a chalk line on a surface. Chalk line marking tool 100 is used to grip a cord covered in powdered chalk, which allows a user to easily snap a chalk line mark using any finger or thumb on either hand. In other words, chalk line marking tool 100 can be used by either hand of a user when the user is positioned at various angles such as sideways, upside down, or any other position. As such, trigger 104 is an ambidextrous trigger because it can be actuated by either a left hand or a right hand of a user. This also removes the need to drive a fastener, such as a screw or nail, into the material to be marked in order to secure one end of the chalk line while snapping a line. Chalk line marking tool 100 has a trigger 104 that allows the cord to be snapped on a surface to create a chalk line mark. Trigger 104 has a trigger actuator 110 that is pulled upwardly against the bias of a trigger spring 170 (FIG. 8). Trigger actuator 110 is in a shape that extends forward and to the sides of the chalk line marking tool 100, which allows a user an extended area to actuate the trigger actuator 110. For example, a user can actuate the trigger actuator 110 from either side, the center, or anywhere in-between. Chalk line marking tool 100 has a main body 102 with main body surface stabilizers 108 that are used to stabilize the main body 102 on a surface when marking a chalk line. Main body 102 has a right trigger channel 116, a left trigger channel 114, a main body end side 178, and a main body trigger side 176. When trigger 104 is pulled, trigger 104 travels up the main body 102 by sliding along the right trigger channel 116 and the left trigger channel 114. Chalk line marking tool 100 has a spring loaded marker 106 that holds the chalk covered cord and moves with trigger 104. For example, if trigger actuator 110 is pulled upwardly, the spring loaded marker 106 also moves upwardly, and when trigger 104 is released, trigger 104 is forced downwardly by the bias of trigger spring 170 (FIG. 8), and the spring loaded marker 106 is also forced downwardly. The main body 102 extends along a main body longitudinal axis 180 and is tilted backwards so that when the chalk line marking tool 100 is sitting on a horizontal axis along a surface 186, the main body 102 of chalk line marking tool 100 is angled from a vertical axis 188 by the angle θ. In other words, horizontal axis along surface 186 is the surface that is the chalk line marking tool 100 rests upon and receives the mark from the chalk line. The vertical axis 188 is perpendicular to the horizontal axis along surface 186. The main body longitudinal axis 180 of chalk line marking tool is designed to be angled downwardly at an angle θ from the vertical axis 188. The main body 102 being angled from the vertical axis 188, has several advantages, such as more stability while maintaining the chalk line marking tool flat on horizontal axis along surface 186, and ease of use with actuating trigger 104 because trigger 104 is easier to reach and see.

As also shown in FIG. 1, chalk line marking tool 100 has a lateral axis 184 that is perpendicular to the main body longitudinal axis 180, and a transverse axis 182 that is perpendicular to the main body longitudinal axis 180 and lateral axis 184, as shown in FIG. 1. In other words, the main body longitudinal axis 180 is equivalent to a tilted Y axis by the angle θ, the lateral axis 184 is equivalent to an X axis in relation to the tilted Y axis (main body longitudinal axis 180), and the transverse axis 182 is equivalent to a Z axis in relation to the lateral axis 184 and the main body longitudinal axis 180. The horizontal axis along surface 186 is equivalent to the X axis of the surface being marked, and vertical axis 188 is equivalent to the Y axis in relation to horizontal axis along surface 186. Vertical axis 188 is perpendicular to the horizontal axis along surface 186. Additionally, it should be noted that the longitudinal direction means in a direction along the main body longitudinal axis 180, lateral direction means in a direction along the lateral axis 184, and transverse direction means in a direction along the transverse axis 182.

In use, main body surface stabilizers 108 of main body 102, and marker surface stabilizers 126 (FIG. 2), of spring loaded marker 106, are placed on a surface to be marked with a chalk line. Cord gripper channel 150 (FIG. 5) holds a marking cord covered with powdered chalk that is used to create a chalk line mark. Trigger actuator 110 is pulled upwardly against the force of trigger spring 170 (FIG. 8). A right trigger rail 160 and a left trigger rail 162 (FIG. 6) travel along left trigger channel 114 and right trigger channel 116. Spring loaded marker 106 is connected to trigger 104 and slides with trigger 104 upwardly along an internal channel 158 (FIG. 6) inside of main body 102. The trigger actuator 110 is released, causing trigger 104 and spring loaded marker 106 to be forced downwardly towards the surface to be marked. Spring loaded marker 106, holding the marking cord, contacts the surface to be marked and creates a chalk line. Because the cord gripper channel 150 (FIG. 5) is positioned flush with the surface to be marked, the marking cord is also flush with the surface which creates a very accurate chalk line. In contrast, if the cord gripper channel 150 (FIG. 5), holding the marking cord, was located in a position not flush with the surface to be marked, when the chalk line is snapped on the surface, the chalk line mark may not be placed on the surface to be marked as accurately as desired since a spacing between the surface and the location of the marking cord above the surface may result in the marking cord not being aligned properly because of an angular displacement, which is the result of the marking cord not being flush with the surface to be marked. For example, if the marking cord was held above the surface to be marked when the spring loaded marker is flush with the surface to be marked, the chalk line starting point may be unclear as a result of angular displacement and therefore less accurate than when the marking cord is flush with the marking surface. Additionally, main body 102 does not move to create the chalk line. The chalk line is created by the movement of trigger 104 and spring loaded marker 106. The main body surface stabilizers 108 remain stable and stationary position on the marking surface while the trigger and spring loaded marker are the parts that move and create the chalk line mark.

Figure 2:
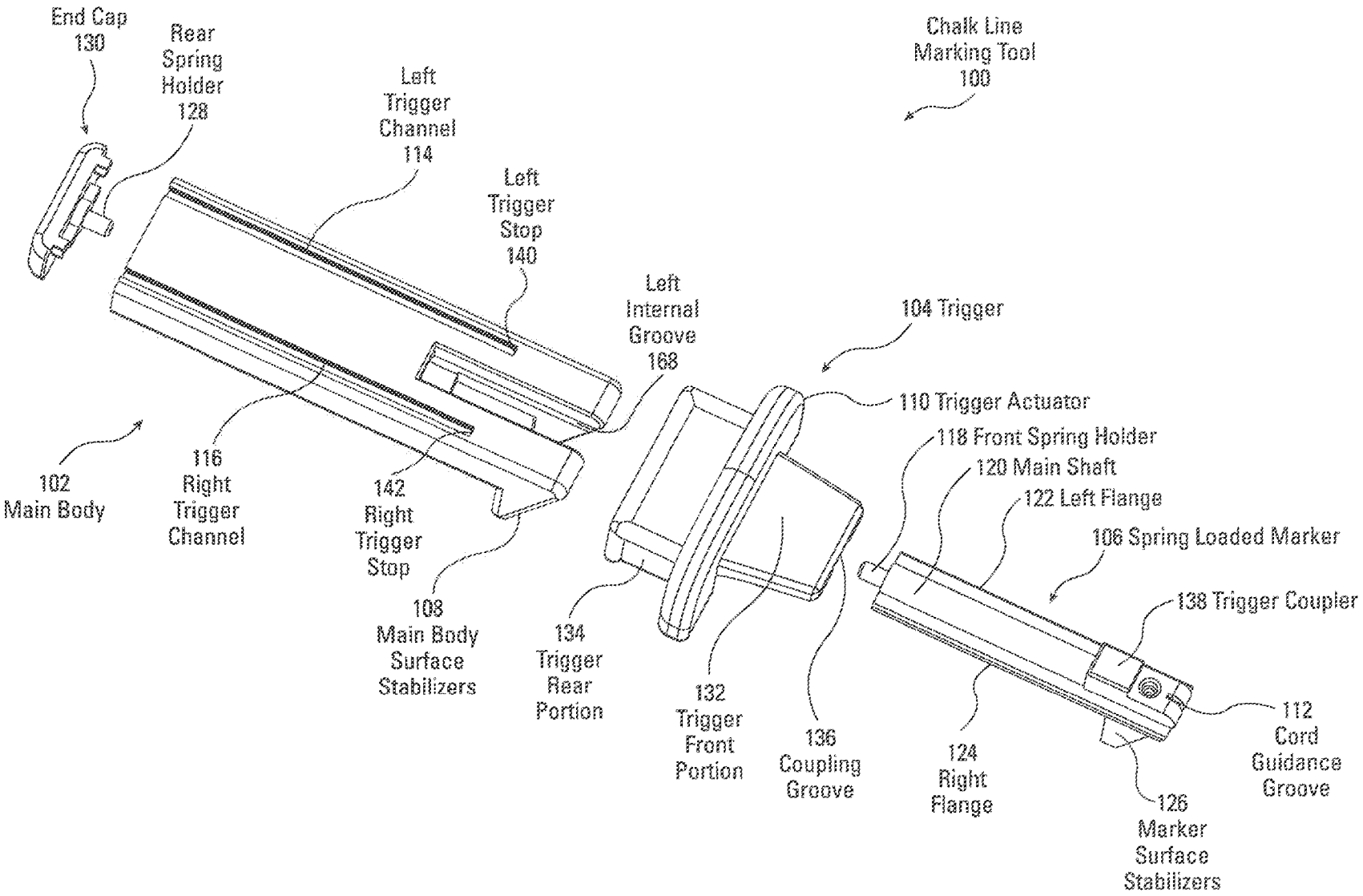
FIG. 2 is an exploded view of FIG. 1.

FIG. 2 is an exploded view of chalk line marking tool 100 showing main body 102 that has main body surface stabilizers 108, right trigger channel 116, left trigger channel 114, and left internal groove 168. Trigger 104 has a trigger rear portion 134 and a trigger front portion 132 that are located on opposite sides of trigger actuator 110. Chalk line marking tool 100 has an end cap 130 that couples with main body 102. End cap 130 has a rear spring holder 128 that couples to a back end 172 of trigger spring 170 (FIG. 8). The spring loaded marker 106 has a front spring holder 118 that couples to a front end 174 of trigger spring 170 (FIG. 8). Spring loaded marker 106 has a left flange 122, a right flange 124, and a main shaft 120 located between the left flange 122 and the right flange 124. Left flange 122 slides along left internal groove 168 of the main body 102, and right flange 124 slides along right internal groove 166 (FIG. 5) when trigger 104 moves. Spring loaded marker 106 has marker surface stabilizers 126 that align with main body surface stabilizers 108 when trigger 104 is a downward position. Marker surface stabilizers 126 assist in maintaining a stable surface for the chalk line marking tool 100 to rest while marking a chalk line. Spring loaded marker 106 has a cord guidance groove 112 that can assist with aligning the chalk covered cord while using the chalk line marking tool 100. Spring loaded marker 106 also has a trigger coupler 138 that is coupled to coupling groove 136 of trigger 104, which causes the spring loaded marker 106 to move with trigger 104 when trigger 104 is in movement. Trigger coupler 138 can be coupled to the coupling groove 136 of the trigger 104 by means known in the art, such as, but not limited to an adhesive.

Figure 3:
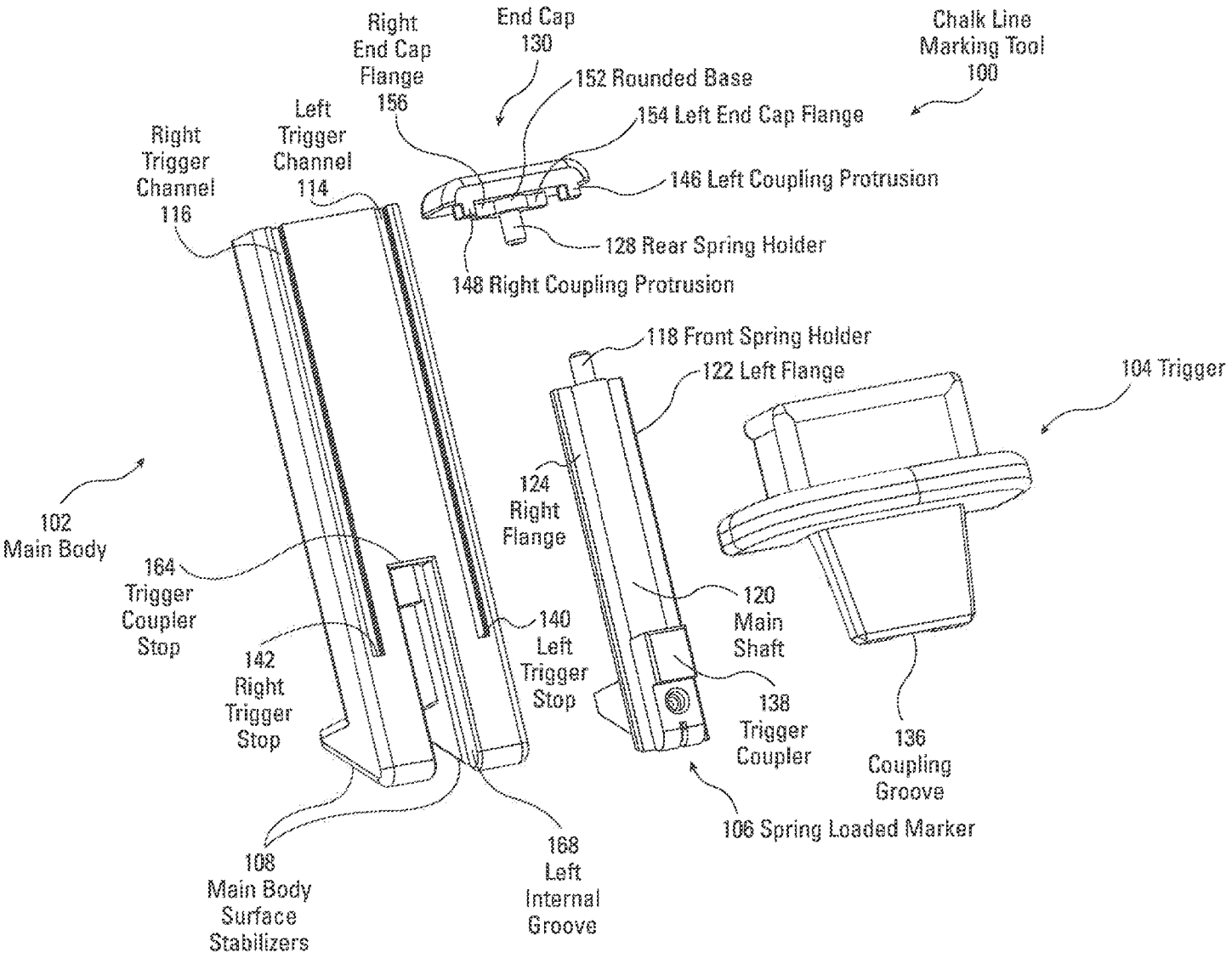
FIG. 3 is a disassembled front view of FIG. 1.
Figure 5:
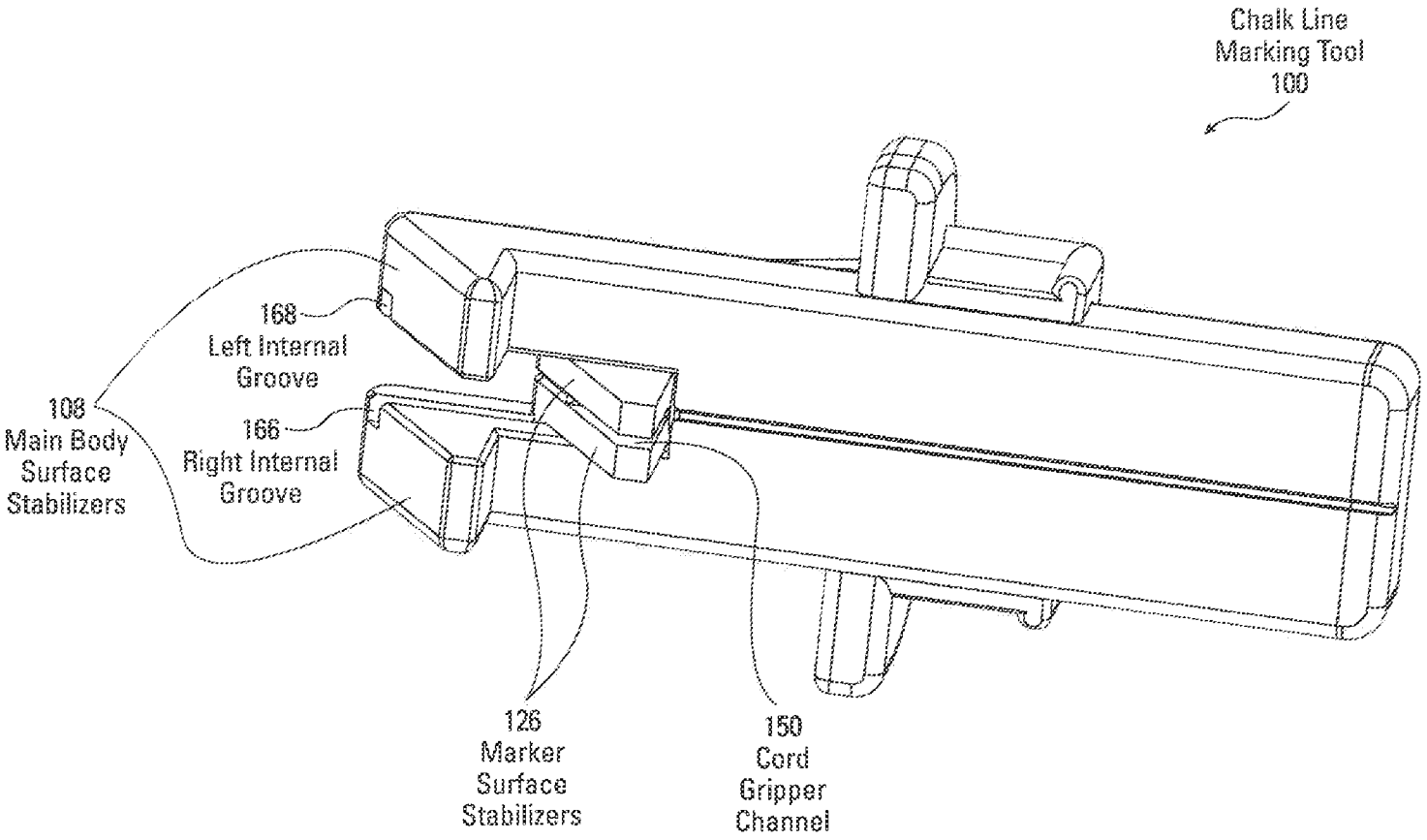
FIG. 5 is a bottom view of FIG. 1.
Figure 6:
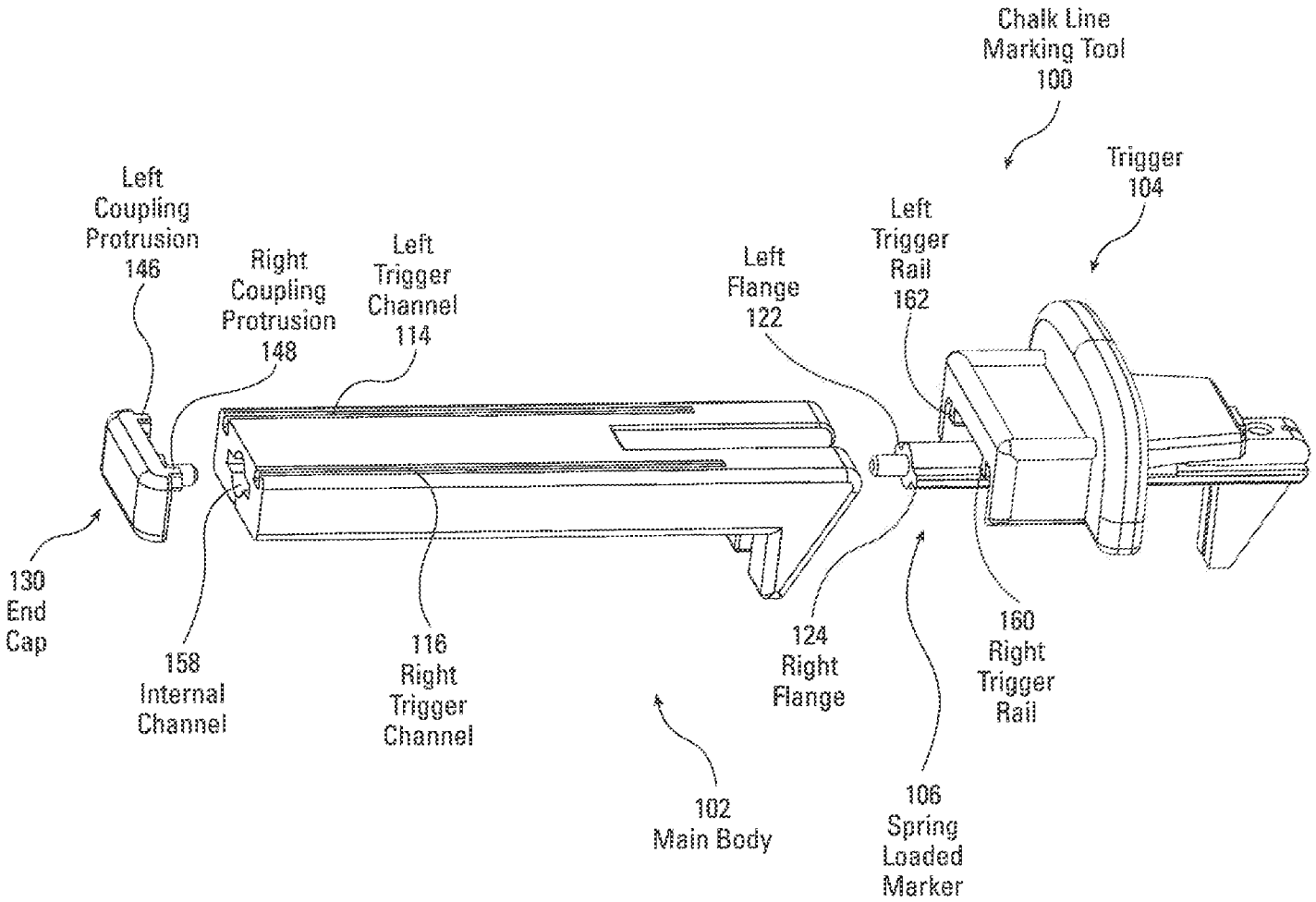
FIG. 6 is an exploded view of FIG. 1.

FIG. 3 is a disassembled front view of the chalk line marking tool 100 showing main body 102, end cap 130, spring loaded marker 106, and trigger 104. Trigger 104 has coupling groove 136 that attaches to trigger coupler 138. As previously described, spring loaded marker 106 has a left flange 122, a right flange 124, and a main shaft 120 that slide in main body 102. The main body 102 has a left internal groove 168 and a right internal groove 166 (FIG. 5) that extend along the inside of the main body 102 in an internal channel 158 (FIG. 6). The left flange 122 slides along left internal groove 168, and the right flange 124 slides along right internal groove 166 (FIG. 5). End cap 130 that couples to main body 102 has a left coupling protrusion 146 and a right coupling protrusion 148 that are shaped to couple with the right trigger channel 116 and left trigger channel 114 on the main body end side 178 (FIG. 1). End cap 130 also has a rounded base 152 between a right end cap flange 156 and a left end cap flange 154 that couple with an internal channel 158 (FIG. 6) of the main body 102. Internal channel 158 (FIG. 6) has a shape that corresponds with and accommodates the rounded base 152, the right end cap flange 156 and the left end cap flange 154 so that the end cap 130 couples with and closes the end of internal channel 158 (FIG. 6). When the spring loaded marker 106 is pulled upwardly along main body 102, trigger coupler 138 abuts a trigger coupler stop 164 which prevents the spring loaded marker 106 from moving farther up in the retracted position. Main body 102 has a right trigger stop 142 and a left trigger stop 140 along the right trigger channel 116 and the left trigger channel 114. Right trigger stop 142 and a left trigger stop 140 prevent trigger 104 from pushing spring loaded marker 106 past the main body surface stabilizers 108 so that the marker surface stabilizers 126 (FIG. 2) of the spring loaded marker 106 remains flush with the main body surface stabilizers 108 when the chalk line marking tool 100 has the trigger 104 in the most downward position, towards the surface to be marked. Trigger 104 has a right trigger rail 160 and a left trigger rail 162 (FIG. 6) that slide along the right trigger channel 116 and the left trigger channel 114 of main body 102. When right trigger rail 160 and a left trigger rail 162 (FIG. 6) abut right trigger stop 142 and a left trigger stop 140, trigger 104 is prevented from moving farther in the downward position. Right trigger stop 142 and a left trigger stop 140 are positioned so that trigger 104 does not push spring loaded marker 106 past main body surface stabilizers 108.

Figure 4:
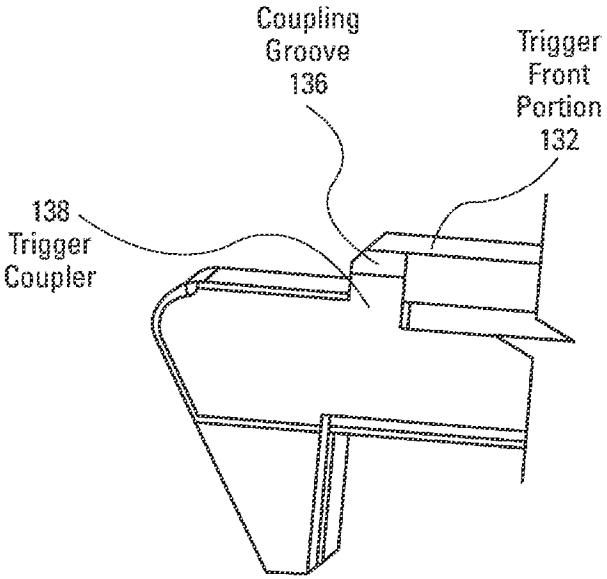
FIG. 4 is a cut-away side view of the trigger and the spring loaded marker of FIG. 1.

FIG. 4 is a cut away side view showing how trigger coupler 138 on the spring loaded marker 106 (FIG. 2) is coupled to coupling groove 136 of the trigger front portion 132.

FIG. 5 is a back view of the chalk line marking tool 100 showing cord gripper channel 150 of the spring loaded marker 106 (FIG. 2) and marker surface stabilizers 126. Cord gripper channel 150 grips the cord covered in chalk that is used to create a chalk line mark. As shown in FIG. 5, the cord gripper channel 150 is located on marker surface stabilizers 126 that are flush with the surface to be marked, which makes the chalk line marking tool 100 very accurate because the cord is flush with the surface to be marked when the chalk line is made. In other words, because the marker surface stabilizers 126 and the main body surface stabilizers 108 are flat with the surface to be marked, the chalk line marking tool 100 is very accurate because the marking cord is flat with the surface to be marked and angular alignment is not a problem. Additionally, the marker surface stabilizers 126, and the main body surface stabilizers 108 provide a stable flat surface. FIG. 5 also shows the left internal groove 168 and the right internal groove 166 on the main body surface stabilizers 108. Left flange 122 and right flange 124 of the spring loaded marker 106 (FIG. 2) slide inside of the left internal groove 168 and the right internal groove.

FIG. 6 is an isometric view of chalk line marking tool 100 showing how end cap 130 couples to the internal channel 158 of the main body 102. Trigger 104 has a right trigger rail 160 and a left trigger rail 162 that mate with and slide along left trigger channel 114 and right trigger channel 116 of the main body 102. The left flange 122 and the right flange 124 of spring loaded marker 106 slide along left internal groove 168 (FIGS. 3 and 5) and right internal groove 166 (FIG. 5).

Figure 7:
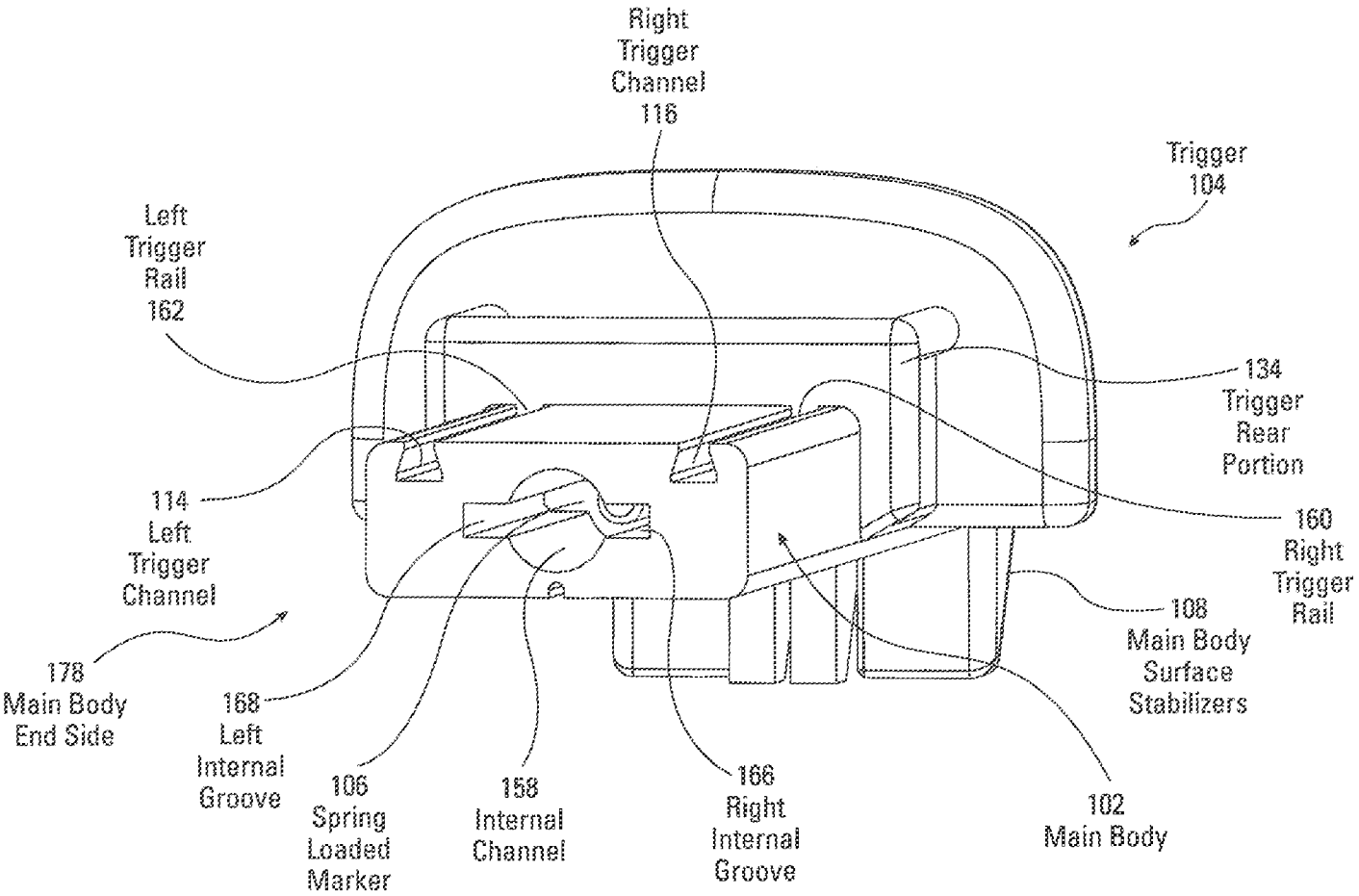
FIG. 7 is an isometric end view of the main body of chalk line marking tool of FIG. 2.

FIG. 7 is an isometric end view of the main body end side 178 of main body 102 coupled to trigger 104 and shown from trigger rear portion 134. Spring loaded marker 106 is disposed inside the internal channel 158. Internal channel 158 has a left internal groove 168 and a right internal groove 166 that extend along internal channel 158. The right trigger rail 160 and the left trigger rail 162 extend along the bottom side of trigger 104 in the longitudinal direction; i.e., along the main body longitudinal axis 180. The right trigger rail 160 and the left trigger rail 162 are disposed in the left trigger channel 114 and the right trigger channel 116. The right trigger rail 160 and the left trigger rail 162 are shaped to correspond with the shape of the left trigger channel 114 and the right trigger channel 116, as shown in FIGS. 6 and 7. Due to the shape of left trigger rail 162 and right trigger rail 160, and corresponding left trigger channel 114 and right trigger channel 166, trigger 104 cannot be pulled outwardly in the transverse direction (i.e. along the transverse axis 182) and become disengaged from main body 178 because of the wide shape of the bottom and the narrow shape of the top of the mating connection between left trigger rail 162 with left trigger channel 114 and right trigger rail 160 with right trigger channel 116. In other words, left trigger rail 162 and right trigger rail 160 are mated with left trigger channel 114 and right trigger channel 166 so that trigger 104 slides in the longitudinal direction (main body longitudinal axis 180) along the main body 102. Trigger 104 cannot be disconnected from main body 102 by applying force in a lateral or transverse direction, which has many advantages such as trigger 104 remaining connected to main body 102 during use regardless of the direction of force is applied to trigger 104. To connect trigger 104 with main body 102, left trigger rail 162 is aligned with and slides into left trigger channel 114, and right trigger rail 160 is aligned with and slides into right trigger channel 116 along the main body longitudinal axis 180 (i.e., the longitudinal direction). To disconnect trigger 104 from main body 102, end cap 130 (FIG. 8) is removed and left trigger rail 162 is slides out left trigger channel 114, and right trigger rail 160 is aligned with and slides into right trigger channel 116 along the main body longitudinal axis 180 (i.e., in the longitudinal direction) and slid off of main body 102.

FIG. 8 is an exploded view of the chalk line marking tool 100 of FIG. 1. FIG. 8 shows trigger spring 170 that has back end 172 and front end 174. Back end 172 couples with rear spring holder 128 on end cap 130, and front end 174 couples with front spring holder 118 on the spring loaded marker 106. Although FIG. 8 shows trigger spring 170 as a helical spring, chalk line marking tool 100 is not limited to a helical spring, and can employ any spring known in the art that biases the spring loaded marker 106 and trigger 104 towards the surface that is intended to be marked. FIG. 8 also further illustrates the main body longitudinal axis 180 that extends along the length of the chalk line marking tool 100, the lateral axis 184 that extends laterally from the main body longitudinal axis 180, and transverse axis 182 that extends transversely from the main body longitudinal axis 180 and the lateral axis 184. The main body longitudinal axis 180, lateral axis 184, and transverse axis 182 are perpendicular to each other. The horizontal axis along surface 186 is the horizontal axis flush with the surface to be marked, and is perpendicular to the vertical axis 188 described and shown in FIG. 1.

Figure 9:
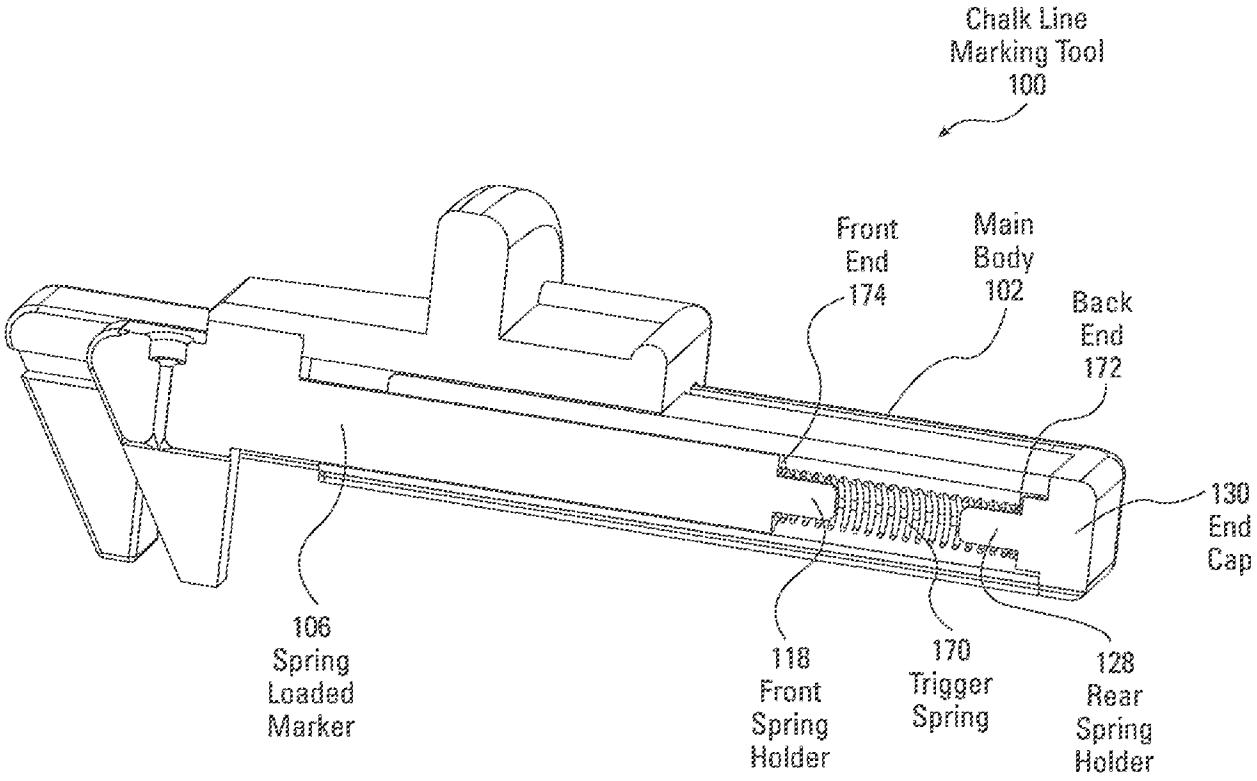
FIG. 9 is a cut-away side view of FIG. 1.

FIG. 9 is a cut away side view of the main body 102 of chalk line marking tool 100, and further illustrating the front end 174 of trigger spring 170 coupled to the front spring holder 118, and the back end 172 of trigger spring 170 coupled to the rear spring holder 128. As was shown and previously described, front spring holder 118 is part of the spring loaded marker 106, and the rear spring holder 128 is part of the end cap 130.

What is claimed is:

1. A chalk line marking tool used with a marking cord to create a chalk line on a surface comprising:

a main body extending in a longitudinal direction;

main body surface stabilizers that extend away from said main body and are configured to be flush with said surface;

a trigger having a trigger front portion, a trigger rear portion, and a trigger actuator positioned between said trigger front portion and said trigger rear portion, wherein said trigger actuator protrudes from said trigger front portion and said trigger rear portion in an axial direction and a transverse direction that are perpendicular to each other and perpendicular to said longitudinal direction of said main body;

a spring loaded marker connected to said trigger and configured to move with said trigger;

marker surface stabilizers on said spring loaded marker that are configured to be flush with said surface and align with said main body surface stabilizers on said main body;

a trigger spring having a front end connected to said spring loaded marker and a back end connected to said end cap.

2. The chalk line marking tool of claim 1 further comprising:

an end cap connected to said main body.

3. The chalk line marking tool of claim 2 further comprising said main body having a left internal groove and a right internal groove that extend along a length of an internal channel of said main body so that said right flange and said left flange of said spring loaded marker are configured to slide along said right internal groove and said left internal groove in said internal channel of said main body.

4. The chalk line marking tool of claim 1 further comprising said spring loaded marker having a right flange and a left flange that protrude in a lateral direction along a length of said spring loaded marker.

5. The chalk line marking tool of claim 1 further comprising a rear spring holder protruding from said end cap in said longitudinal direction;

a front spring holder protruding from said spring loaded marker in said longitudinal direction so that said rear spring holder is disposed inside of said back end of said trigger spring, and said front spring holder is disposed inside of said front spring holder.

6. The chalk line marking tool of claim 1 further comprising:

a left trigger rail and a right trigger rail that protrude from said trigger in a transverse direction and extend along said trigger in said longitudinal direction, so that said left trigger rail and said right trigger rail are configured to be disposed in, and slide along a left trigger channel and a right trigger channel that extend along said longitudinal direction of said main body, and said left trigger rail and said right trigger rail have a shape that corresponds with a shape of said left trigger rail and said right trigger rail so that said trigger only moves in said longitudinal direction along said main body.

7. The chalk line marking tool of claim 1 further comprising said main body and said main body surface stabilizers are a unitary piece with said main body angled backwards by an angle θ from a vertical axis that is perpendicular to the axis of said surface.

8. The chalk line marking tool of claim 1 further comprising said trigger is an ambidextrous trigger.

9. The chalk line marking tool of claim 1 further comprising said marker surface stabilizers of said spring loaded marker further comprising a cord gripping channel located on the bottom of said marker surface stabilizers and configured to grip a chalk line cord.

10. A method of making a chalk line marking tool comprising:

securing one end of a trigger spring to a rear spring holder on an end cap, and securing the opposite end of said trigger spring to a front spring holder on a spring loaded marker;

sliding said spring loaded marker into a main body of said chalk line marking tool;

sliding a right trigger rail and a left trigger rail located on a trigger into a right trigger channel and a left trigger channel located on said main body so that said trigger slides along said right trigger channel and said left trigger channel of said main body;

securing said end cap to said main body of said chalk line marking tool so that said trigger spring biases said spring loaded marker towards main body surface stabilizers on said main body;

securing said trigger to said spring loaded marker so that said spring loaded marker moves with said trigger.

11. A chalk line marking tool used with a marking cord to create a chalk line on a surface comprising:

a main body extending along a main body longitudinal axis;

main body surface stabilizers that extend away from said main body along a transverse axis that is perpendicular to said main body longitudinal axis, and said main body surface stabilizers are configured to be flush with said surface;

a trigger having a trigger front portion extending along said main body longitudinal axis, a trigger rear portion extending along said main body longitudinal axis, and a trigger actuator positioned between said trigger front portion and said trigger rear portion, wherein said trigger actuator protrudes from said trigger front portion and said trigger rear portion along said transverse axis, and along a lateral axis that extends laterally from said main body longitudinal axis and is perpendicular to said main body longitudinal axis and said transverse axis;

a spring loaded marker connected to said trigger and configured to move with said trigger comprising:

a main shaft that extends along said main body longitudinal axis;

a right flange extending from said main body longitudinal axis along said lateral axis;

a left flange extending from said main body longitudinal axis along said lateral axis;

marker surface stabilizers that protrude from said main body longitudinal axis along said transverse axis, and are configured to be flush with said surface and align with said main body surface stabilizers on said main body;

an end cap connected to said main body;

a trigger spring having a front end connected to said spring loaded marker and a back end connected to said end cap.

* * * * *